US009593298B2

(12) United States Patent
Cotrell et al.

(10) Patent No.: US 9,593,298 B2
(45) Date of Patent: Mar. 14, 2017

(54) COMPOSITION COMPRISING FATTY ACYL ISETHIONATE AND SYNTHETIC WAX AND METHOD PRODUCING THE SAME

(75) Inventors: Phillip Loraine Cotrell, Salisbury, NC (US); Philip Arie Matena, Rumson, NJ (US); Stephen Moss O'Connor, Charlotte, NC (US)

(73) Assignee: Innospec Limited (GB)

( * ) Notice: Subject to any disclaimer, the term of this patent is extended or adjusted under 35 U.S.C. 154(b) by 0 days.

(21) Appl. No.: 14/127,720

(22) PCT Filed: Jun. 14, 2012

(86) PCT No.: PCT/GB2012/051363

§ 371 (c)(1),
(2), (4) Date: Jan. 24, 2014

(87) PCT Pub. No.: WO2012/175935

PCT Pub. Date: Dec. 27, 2012

(65) Prior Publication Data

US 2014/0155309 A1 Jun. 5, 2014

Related U.S. Application Data

(60) Provisional application No. 61/498,711, filed on Jun. 20, 2011.

(51) Int. Cl.

| | |
|---|---|
| ***C11D 17/00*** | (2006.01) |
| ***C11D 1/12*** | (2006.01) |
| ***C11D 3/37*** | (2006.01) |
| ***C11D 10/04*** | (2006.01) |
| ***C11D 17/06*** | (2006.01) |

(52) U.S. Cl.

CPC ..... *C11D 17/0065* (2013.01); *C11D 1/126* (2013.01); *C11D 3/3749* (2013.01); *C11D 3/3753* (2013.01); *C11D 10/042* (2013.01); *C11D 17/006* (2013.01); *C11D 17/06* (2013.01)

(58) Field of Classification Search

None

See application file for complete search history.

(56) References Cited

U.S. PATENT DOCUMENTS

| | | | | |
|---|---|---|---|---|
| 3,320,292 | A | 5/1967 | Cahn et al. | |
| 4,405,526 | A | 9/1983 | Lamberti et al. | |
| 5,981,451 | A | 11/1999 | Farrell et al. | |
| 2007/0275021 | A1* | 11/2007 | Lee et al. | 424/401 |
| 2010/0119467 | A1* | 5/2010 | Dumousseaux et al. | 424/70.7 |

FOREIGN PATENT DOCUMENTS

| | | | |
|---|---|---|---|
| EP | 0189332 | A2 | 7/1986 |
| EP | 0585071 | A1 | 3/1994 |
| GB | 824447 | | 12/1959 |
| WO | 2005075623 | A1 | 8/2005 |
| WO | 2007130390 | A2 | 11/2007 |

OTHER PUBLICATIONS

International Search Report in International Application No. PCT/GB2012/051363 dated Sep. 26, 2012.

International Preliminary Report on Patentability for International Application No. PCT/GB2012/051363 dated Dec. 23, 2013.

* cited by examiner

*Primary Examiner* — Necholus Ogden, Jr.

(74) *Attorney, Agent, or Firm* — Janine M. Susan; Burns & Levinson LLP

(57) ABSTRACT

A method of preparing a component of a personal care bar, the method comprising: (a) providing a composition comprising an isethionate surfactant at a temperature of at least 20° C.; (b) combining the composition comprising the isethionate surfactant with a synthetic 5 wax and optional further components at a temperature of at least 120° C.; and (c) cooling the mixture obtained in step (b).

26 Claims, No Drawings cCOMPOSITION COMPRISING FATTY ACYL ISETHIONATE AND SYNTHETIC WAX AND METHOD PRODUCING THE SAME

CROSS-REFERENCE TO RELATED APPLICATIONS

This application is a U.S. national stage application under 35 U.S.C. 371 of co-pending International Application No. PCT/GB2012/051363 filed on Jun. 14, 2012 and entitled COMPOSITION COMPRISING FATTY ACYL ISETHIONATE AND SYNTHETIC WAX AND METHOD PRODUCING THE SAME, which in turn claims priority to U.S. Provisional Patent Application No. 61/498,711 filed on Jun. 20, 2011, both of which are incorporated by reference herein in their entirety for all purposes.

The present invention relates to personal cleansing bars and methods of preparing the same.

For centuries people have been using soap for washing and bathing. Soap is made from alkali metal salts, especially sodium salts of long chain fatty acids. These compounds are very effective at cleaning and are cheap and easy to prepare. Conventional soap bars comprise a large portion, typically 60-80% by weight of fatty acid soaps, often a mixture of fatty acid soaps, selected to obtain the required properties of lather, bar structure etc. Conventional soap bars are manufactured by milling, plodding and stamping a semi solid mass of soaps and other components.

In this specification when using the term soap unless otherwise specified we mean to refer to alkali metal salts, especially sodium salts of fatty acids, typically having a chain length of 12 to 22 carbons atoms.

Although cheap, effective and easy to prepare, soap can be drying to the skin and recently people have sought to use alternative compounds having milder properties. Examples of such compounds are acyl isethionates. These have been shown to be mild to the skin, to lather well and produce good foam. However, isethionates are considerably more expensive than soap. It is therefore common practice to provide a cleansing bar which combines traditional soap compounds with synthetic detergents such as isethionates. Such cleansing bars provide the desired properties of mildness and improved lather due to the presence of the synthetic detergent but the cost is reduced by the inclusion of traditional soap compounds.

One method of producing personal care bars involves mixing the synthetic detergent and traditional soap in a "molten" process. Typically the "molten" part of the process is carried out at around 80-100° C.

One such process is described in EP0189332 and involves combining an alkali metal or (substituted) ammonium fatty acid soap with a C10-C16 acyl isethionate salt and water; heating and mixing the component blend at a preferred mixing temperature of 93°-120° C. at atmospheric pressure, or lower temperatures at reduced pressure; and terminating the mixing after the blend reaches a second peak in viscosity. Moisture content, temperature and control of mixing and viscosity are critical to obtaining products of desired properties. Low moisture content for example leads to bars having an undesirable sandy texture.

An alternative process for preparing cleansing bars containing synthetic detergents and traditional soap involves first preparing chips of the synthetic detergent and then combining these with soap and other ingredients in a non-molten process, for example using a high energy, high shear mixer before forming the mixture into bars. However, the resultant product may have a gritty feel as the synthetic detergent and the soap dissolve at different rates. This has had the effect of limiting the amount of soap which can be included in such a cleansing bar when using a non-molten process.

One method to address the "grittiness" issue in bars containing a high level of soap and synthetic detergent has been proposed by Unilever in U.S. Pat. No. 5,981,451. This involves a preprocessing step in which crude solid acyl isethionate (obtained from the reaction of fatty acids and alkali metal isethionate) is blended with fatty acid soap, optional surfactant and minor components using the same process that is used to make the final bars. However a disadvantage of this process is that it is complex.

It is an aim of the present invention to provide an improved method by which personal cleansing bars can be prepared and to provide a cleansing bar having improved properties. It is a further aim of the present invention also to provide a synthetic-detergent containing component by an improved process. Such a component can desirably be combined with soap in varying amounts to provide low soap content and high soap content compositions with improved properties, for example a non-gritty feel.

The present inventors have found that combining an isethionate surfactant and a synthetic wax at high temperatures provides a synthetic-detergent containing component which can be used to make personal cleansing bars having desirable properties. Disadvantages, for example discolouration or malodour, are reduced.

According to the first aspect of the present invention there is provided a method of preparing a component of a personal care bar, the method comprising:

(a) providing a composition comprising an isethionate surfactant at a temperature of at least 120° C.;

(b) combining the composition comprising the isethionate surfactant with a synthetic wax and optional further components at a temperature of at least 120° C.; and (c) cooling the mixture obtained in step (b).

Step (a) of the present invention involves providing an isethionate surfactant at a temperature of at least 120° C.

In preferred embodiments the isethionate surfactant comprises a compound of formula (I):

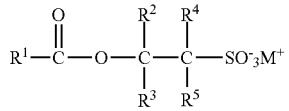

(I)

wherein $R^1$ represents a $C_{4-36}$ substituted or unsubstituted hydrocarbyl group; each of $R^2$, $R^3$, $R^4$ and $R^5$ independently represents a hydrogen atom or a $C_{1-4}$ alkyl group and $M^+$ represents a cation.

Preferably $R^1$ is selected from a substituted or unsubstituted alkyl, alkenyl, aryl or alkylaryl group. More preferably $R^1$ is selected from a substituted or unsubstituted alkyl or alkenyl group. Most preferably $R^1$ is an unsubstituted alkyl or alkenyl group, especially an unsubstituted alkyl group.

Preferably $R^1$ represents a $C_{5-30}$ alkyl group, preferably a $C_{7-24}$ alkyl group, more preferably a $C_{7-21}$ alkyl group, most preferably a $C_{7-17}$ alkyl group.

In some embodiments $R^2$ represents a $C_{1-4}$ alkyl group, suitably a $C_{1-4}$ alkyl group in which a propyl or butyl group, when present, is straight-chained. Suitably $R^2$ may represent an n-propyl, ethyl or preferably, a methyl group. However in preferred embodiments $R^2$ is hydrogen.

Preferably $R^3$ represents a hydrogen atom.

In some embodiments $R^4$ and $R^5$ represents a hydrogen atom and the other represents a hydrogen atom or a $C_{1-4}$ alkyl group. Suitable one of $R^4$ and $R^5$ represents a hydrogen atom or a $C_{1-4}$ alkyl group in which a propyl or butyl group is straight-chain. Preferably one of $R^4$ and $R^5$ represents an n-propyl, ethyl or methyl group or, most preferably, a hydrogen atom. Most preferably both $R^4$ and $R^5$ represent hydrogen atoms.

In especially preferred embodiments each of the $R^2$, $R^3$, $R^4$ and $R^5$ is hydrogen and the isethionate compound is of formula $R^1CO_2CH_2CH_2SO_3M$.

Preferably $M^+$ represents an optionally substituted ammonium cation or, most preferably, a metal cation. Suitable ammonium cations include $NH_4^+$ and the ammonium cation of triethanolamine. Suitable metal cations include alkali metal cations, for example sodium, lithium and potassium cations, and alkaline earth metal cations, for example calcium and magnesium cations. Preferably $M^+$ represents a potassium cation, or, especially, a sodium cation.

$R^1$ may be an alkyl group or an alkenyl group. Preferably $R^1$ is an alkyl group. In some embodiments the component surfactant of the present invention may comprise a mixture of fatty acids to form a mixture of compounds of formula (I) in which $R^1$ may be different.

$R^1$ is preferably the residue of a fatty acid. Fatty acids obtained from natural oils often include mixtures of fatty acids. For example the fatty acid obtained from coconut oil contains a mixture of fatty acids including $C_{12}$ lauric acid, $C_{14}$ myristic acid, $C_{16}$ palmitic acid, $C_8$ caprylic acid, and $C_{18}$ stearic and oleic.

$R^1$ may include the residue of one or more naturally occurring fatty acids and/or of one or more synthetic fatty acids. In some preferred embodiments $R^1$ consists essentially of the residue of a single fatty acid.

Examples of carboxylic acids from which $R^1$ may be derived include butyric acid, hexanoic acid, caproic acid, caprylic acid, capric acid, lauric acid, myristic acid, palmitic acid, palmitoleic acid, stearic acid, oleic acid, linoleic acid, arachidic acid, gadoleic acid, arachidonic acid, eicosapentanoic acid, behinic acid, eruic acid, docosahexanoic lignoceric acid, naturally occurring fatty acids such as those obtained from coconut oil, tallow, palm kernel oil, butterfat, palm oil, olive oil, corn oil, linseed oil, peanut oil, fish oil and rapeseed oil; synthetic fatty acids made as chains of a single length or a selected distribution of chain lengths; and mixtures thereof. Most preferably $R^1$ comprises the residue of lauric acid, that is a saturated fatty acid having 12 carbon atoms or the residue of mixed fatty acids derived from coconut oil.

Most preferably the composition of the present invention comprises sodium lauroyl isethionate and/or sodium cocoyl isethionate. Sodium lauroyl isethionate is especially preferred.

In some embodiments the isethionate surfactant may include a mixture of more than one compound of formula (I).

The isethionate surfactant may further comprise one or more of sodium lauroyl methyl isethionate, sodium cocoyl methyl isethionate and sodium oleoyl methyl isethionate.

Step (a) involves providing a composition comprising an isethionate surfactant at a temperature of at least 120° C. Preferably the composition is a liquid composition. By this it is meant that the composition as a whole is free flowing and can be poured. It may comprise minor components which are in solid form. Preferably any undissolved solid components are dispersed throughout the composition.

Suitably the composition comprising the isethionate surfactant is provided in step (a) at a temperature of at least 130° C., preferably at least 140° C., more preferably at least 150° C., suitably at least 160° C. Preferably the isethionate surfactant is provided at a temperature of at 170° C., preferably at least 180° C., suitably at least 190° C., preferably at least 200° C., more preferably at least 210° C., for example at least 220° C. It may be provided at temperature of up to 275° C., preferably up to 260° C., for example up to 250° C.

Preferably the composition provided in step (a) is the crude reaction mixture obtained by a process used to prepare the isethionate surfactant.

In such embodiments the composition provided may comprise unreacted starting materials from the esterification reaction used to prepare the isethionate. Thus the composition provided in step (a) may comprise isethionate salts and/or fatty acids and/or catalyst.

Step (a) may involve providing an isethionate surfactant prepared by any suitable method. Such methods will be known to the person skilled in the art and include those described for example in GB824447, U.S. Pat. No. 3,320,292 and U.S. Pat. No. 4,405,526.

In the method of GB824447 anionic surfactants are prepared from carboxylic acids and 2 hydroxyalkane sulfonic acids. The reaction is carried out at 185 to 210° C. in the presence of an orthophosphoric acid catalyst in an inert atmosphere.

U.S. Pat. No. 3,320,292 describes the direct esterification of a hydroxyalkane sulfonate with a carboxylic acid using zinc oxide or zinc soaps as a catalyst. The reaction is carried out at 200 to 240° C. in an inert atmosphere of carbon dioxide or nitrogen. A non-oxidising atmosphere is used to reduce colour formation. A development of this process is described in U.S. Pat. No. 4,405,526 in which a specific ratio of zinc oxides and organic sulfonic acids are used as a catalyst at temperatures of 200 to 255° C.

Step (a) involves providing a composition comprising an isethionate surfactant at a temperature of at least 120° C. This composition is preferably the direct product of the reaction used to prepare the isethionate. Preferably this composition is used directly and is not cooled and allowed to solidify and then reheated, i.e. the liquid composition obtained by reaction of an alkali metal isethionate and fatty acid is used directly without producing an intermediate solid. By using the composition directly in this way the inventors have found that less discolouration and fewer bad odours are produced. However embodiments in which the isethionate component is first prepared in a separate step and then reheated are not excluded from the scope of the invention.

Step (a) preferably involves preparing an isethionate surfactant at a temperature of at least 120° C. Suitably step (a) involves preparing an isethionate surfactant at a temperature of at least 160° C., preferably at least 180° C., more preferably at least 200° C.

An especially preferred method by which the isethionate surfactant is prepared is by heating a fatty acid with sodium isethionate with sodium isethionate and a zinc oxide catalyst to a temperature of 230 to 250° C., preferably 240° C. under an inert atmosphere (for example a nitrogen blanket). The mixture is then heated for 1 to 4 hours, for example about 2 hours, with removal of water. Excess fatty acid may be removed if required by combination of vacuum distillation and/or a nitrogen sweep.

Step (b) involves combining synthetic wax and optional further components with the composition comprising the isethionate surfactant provided in step (a). Thus step (b) preferably involves combining the synthetic wax and optional further components with a crude isethionate surfactant obtained directly from the process used to prepare it.

Preferably step (b) is carried out in a liquid phase, that is the starting composition provided in step (a) and the composition obtained in step (b) are liquid compositions. By this it is meant that the composition as a whole is free flowing and can be poured. It may comprise minor components which are in solid form. Preferably any undissolved solid components are dispersed throughout the composition. Thus one or more of the ingredients added in step (b) may be provided in solid form.

Preferably the synthetic wax provided in step (b) is in liquid form under the conditions used during the combination.

Step (b) is carried out at a temperature of a least 120° C., suitably at least 130° C., preferably at least 140° C., more preferably at least 150° C., for example at least 160° C. or at least 170° C. Preferably step (b) is carried out at a temperature of a least 180° C., preferably at least 190° C., more preferably at least 200° C., for example at least 210° C. or at least 220° C.

Preferably step (b) is carried out under an inert atmosphere.

The synthetic wax used in step (b) may be selected from any wax material that is synthetically prepared. By synthetic wax we mean to exclude naturally occurring waxes, for example beeswax and waxes obtained directly from naturally occurring petroleum products.

Preferably the synthetic wax used in step (b) is selected from polyolefins, polyalkylene glycol esters, olefin copolymers, olefin terpolymers, Fischer Tropsch waxes and fatty acid amides.

Preferably the synthetic wax is selected from polyolefins, olefin copolymers and olefin terpolymers, more preferably it is selected from olefin copolymers and olefin terpolymers. Most preferably the synthetic wax comprises an olefin copolymer.

Preferred polyolefins for use herein are selected from polyethylene, ethylene—butylene copolymers and copolymers of ethylene and other olefins. Most preferred polyolefins are polyethylene.

Preferred olefin copolymers are copolymers of olefins with unsaturated esters, unsaturated amides, unsaturated acids or unsaturated anhydrides. More preferred are copolymers of ethylene with unsaturated esters, unsaturated amides, unsaturated acids or unsaturated anhydrides. Especially preferred are copolymers of ethylene with unsaturated esters. Most preferred are copolymers of ethylene with vinyl esters, for example ethylene vinyl acetate copolymers.

Preferred olefin terpolymers are terpolymers having monomers selected from olefin, unsaturated esters, unsaturated acids, unsaturated amides or unsaturated anhydrides. Preferably at least one of the monomers is an olefin, preferably ethylene. Preferably another of the monomers is an unsaturated ester, preferably selected from vinyl esters, esters of acrylic acid or esters of methacrylic acid and most preferably a vinyl ester, for example vinyl acetate.

Suitable polyethylene waxes for use herein include any polyethylene waxes suitable for use in personal care applications. Preferably the polyethylene waxes will have a drop melting point of greater than 70° C., preferably greater than 80° C., for example greater than 90° C. or greater than 100° C.

Suitably the polyethylene waxes will have a drop melting point of up to 150° C., preferably up to 140° C., suitably up to 135° C., for example up to 120° C.

In preferred embodiments the synthetic wax is selected from polyethylene wax and ethylene vinyl acetate copolymer wax. An ethylene vinyl acetate copolymer wax is especially preferred.

In especially preferred embodiments step (b) involves combining the composition comprising the isethionate surfactant with an ethylene vinyl acetate copolymer wax.

Especially preferred ethylene vinyl acetate copolymers are those having 2-30% vinyl acetate, preferably 3-20%, suitably 8-18%, more preferably 9-17% vinyl acetate.

Preferred ethylene vinyl acetate copolymers are those having a drop melting point of greater than 70° C., preferably greater than 80° C., suitably greater than 85° C., for example greater than 90° C.

Preferred ethylene vinyl acetate copolymers for use herein have a melting point of less than 180° C., for example less than 170° C., preferably less than 140° C., more preferably less than 130° C. or less than 120° C. Preferably the ethylene vinyl acetate copolymer has a melting point between 80° C. and 110° C.

Preferred ethylene vinyl acetate copolymers for use herein have a viscosity at 140° C. of from 50 to 10000 $mm^2s^{-1}$, preferably from 100 to 4000, suitably from 150 to 3000, preferably from 200 to 2000, more preferably from 250 to 750, for example from 300 to 500 $mm^2s^{-1}$.

In step (b) optional further components may be combined with the composition comprising the isethionate surfactant and synthetic wax. Suitable further components include free fatty acids, salts of fatty acids, soap, salts of isethionate surfactants, water, pigments and dyes, fragrances, perfumes, additional surfactants, benzoate esters, maltodextrin, other carbohydrates, starches and dextrins, inorganic particulate materials such as talc, kaolin, bentonite clay, aluminosilicate clays or other clays, carbonate or sulphate salts, glycerol esters or ethylene glycol esters, sugars and crystalline polyols.

The components may be combined in step (b) by any suitable means. Preferably the composition is in liquid form, is free flowing and can be poured or stirred. A preferred method by which the components can be combined in step (b) is by stirring.

Step (c) involves cooling the mixture obtained in step (b). Any suitable cooling method may be used. Suitable methods will be known to the person skilled in the art.

Preferably in step (c) the mixed is cooled sufficiently to form a solid. In some preferred embodiments step (c) involves a handling step in which the solid is processed into a useful manageable form during cooling. Step (c) may involve a single stage or multistage cooling process.

In some embodiments step (c) may involve partially cooling the liquid obtained in step (b) in the mixing vessel, for example using limpet coils. This may be followed by a further stage in which the material both cools and forms solid handleable material. For example this second stage may involve pouring or injecting the hot liquid onto a cooled metal sheet, belt or roller so that the liquid solidifies. The solid is then removed and if necessary cut into pieces of the required size. Alternatively, the hot liquid may be cooled and extruded to produce noodles. Processes for flaking, extruding, etc. are known to the person skilled in the art.

The solid handleable form thereby produced may be referred to as solid chips. By chips, we mean to include any suitable solid form including flakes, powders, chunks, small pieces, granules, noodles etc.

Thus the method of the first aspect of the present invention preferably provides a synthetic-detergent containing component for a personal care bar in the form of chips comprising an isethionate surfactant intimately mixed with a synthetic wax and optional further components.

Preferably the synthetic-detergent containing component obtained in the method of the first aspect comprises at least 20 wt % isethionate surfactant, preferably at least 30 wt %, more preferably at least 40 wt %, suitably at least 45 wt %, for example at least 50 wt %.

Suitably the synthetic-detergent containing component obtained in the method of the first aspect comprises up to 95 wt % isethionate surfactant, preferably up to 90 wt %, more preferably up to 85 wt %, for example up to 75 wt %.

Preferably the synthetic-detergent containing component obtained in the method of the first aspect comprises at least 0.5 wt % synthetic wax, preferably at least 0.75 wt %, more preferably at least 1 wt %.

Suitably the synthetic-detergent containing component obtained in the method of the first aspect comprises up to 10 wt % synthetic wax, preferably up to 7.5 wt %, more preferably up to 5 wt %.

The synthetic-detergent containing component provided by the method of the first aspect may comprise free fatty acids. These fatty acids may be present as unreacted starting materials, or they may be added as additional components in step (b) or a mixture of both. The fatty acids may be a mixture of fatty acids. The fatty acids present as unreacted starting materials may be the same or different fatty acids to those added in step (b).

Preferably the synthetic-detergent containing component obtained in the method of the first aspect comprises at least 5 wt % fatty acids, preferably at least 10 wt %, more preferably at least 15 wt %.

Suitably the synthetic-detergent containing component obtained in the method of the first aspect comprises up to 60 wt % fatty acids, preferably up to 50 wt %, more preferably up to 40 wt %.

The synthetic-detergent containing component of the first aspect may comprise isethionate salts. These isethionate salts may be present as unreacted starting materials, or they may be added as additional components in step (b) or a mixture of both.

Preferably the synthetic-detergent containing component obtained by the method of the first aspect comprises less than 40 wt % isethionate salts, preferably less than 30 wt %, more preferably less than 20 wt % and most preferably less than 15 wt % for example less than 10 wt %.

As mentioned above in preferred embodiments the method of the first aspect provides a synthetic detergent-containing component in the form of chips which are easy to handle. These chips can be directly combined with traditional soap to form a personal care bar. An advantage of the chips provided by the method of the first aspect of the present invention is that they can be used directly in a non-molten process and simply combined with a traditional soap. However, the chips could also be used in a molten process if desired.

According to a second aspect of the present invention there is provided a method of preparing a personal care bar, the method comprising preparing a component of a personal care bar according to the method of the first aspect and combining the component with a soap component and optional further ingredients.

In preferred embodiments the method of the second aspect involves combining chips of the component prepared by the method of the first aspect with chips of soap, and optional further ingredients. The method of the second aspect preferably comprises:

(a) providing a composition comprising an isethionate surfactant at a temperature of at least 120° C.;

(b) combining the composition comprising the isethionate surfactant with a synthetic wax and optional further components at a temperature of at least 120° C.; and (c) cooling the mixture obtained in step (b) and forming into chips; and (d) combining the chips obtained in step (c) with chips of a soap component and optional further ingredients.

The method of the second aspect involves mixing the synthetic-detergent containing component with a soap component. The soap component comprises compounds that are commonly known as soaps, i.e. salts of fatty acids.

A soap component may include the alkali metal or alkanol ammonium salts of aliphatic alkane or alkene monocarboxylic acids. Sodium, potassium, mono-, di- and tri-ethanol ammonium cations, or combinations thereof, are suitable for purposes of this invention. In general, sodium soaps are used in the compositions of this invention, but from about 1% to about 25% of the soap may be potassium soaps. The soap component useful herein may include the well known alkali metal salts of natural of synthetic aliphatic (alkanoic or alkenoic) acids having about 12 to 22 carbon atoms, preferably about 12 to about 18 carbon atoms. They may be described as alkali metal carboxylates of acrylic hydrocarbons having about 12 to about 22 carbon atoms.

Soaps having the fatty acid distribution of coconut oil may provide the lower end of the broad molecular weight range. Those soaps having the fatty acid distribution of peanut or rapeseed oil, or their hydrogenated derivatives, may provide the upper end of the broad molecular weight range.

It is preferred to use soaps having the fatty acid distribution of coconut oil or tallow, or mixtures thereof, since these are among the more readily available fats. The proportion of fatty acids having at least 12 carbon atoms in coconut oil soap is about 85%. This proportion will be greater when mixtures of coconut oil and fats such as tallow, palm oil, or non-tropical nut oils or fats are used, wherein the principal chain lengths are C16 and higher. Preferred soaps for use in the present invention have at least about 85% fatty acids having about 12 to 18 carbon atoms.

Coconut oil employed for the soap component may be substituted in whole or in part by other "high-alluric" oils, that is, oils or fats wherein at least 50% of the total fatty acids are composed of lauric or myristic acids and mixtures thereof. These oils are generally exemplified by the tropical nut oils of the coconut oil class. For instance, they include: palm kernel oil, babassu oil, ouricuri oil, tucum oil, cohune nut oil, murumuru oil, jaboty kernel oil, khakan kernel oil, dika nut oil, and ucuhuba butter.

A preferred soap component is a mixture of about 15% to about 20% coconut oil and about 80% to about 85% tallow. These mixtures contain about 95% fatty acids having about 12 to about 18 carbon atoms. The soap component may be prepared from coconut oil, in which case the fatty acid content is about 85% of C12-C18 chain length.

The soaps may contain unsaturation in accordance with commercially acceptable standards. Excessive unsaturation is normally avoided.

The soap component may be made by the classic kettle boiling process or modern continuous soap manufacturing processes wherein natural fats and oils such as tallow or coconut oil or their equivalents are saponified with an alkali metal hydroxide using procedures well known to those skilled in the art. Alternatively, the additional soaps may be made by neutralizing fatty acids, such as lauric (C12), myristic (C14), palmitic (C16), or stearic (C18) acids with an alkali metal hydroxide or carbonate.

Preferably the personal care bar produced by the method of the second aspect comprises from 10 to 90 wt %, preferably from 20 to 80 wt % of the synthetic-detergent containing component prepared by the method of the first aspect.

Preferably the personal care bar produced by the method of the second aspect comprises from 5 to 90 wt % of the soap component, preferably from 10 to 70 wt %, more preferably from 10 to 60 wt %.

Preferably the personal care bar produced by the method of the second aspect comprises less than 30 wt % ingredients other than the synthetic-detergent containing component and the soap component.

Optional further ingredients which may be present include those additives that are typical of or customary for use in personal care bars. Suitable further ingredients include structuring aids or fillers which can be used to improve the processing properties of the bar mixture, to enhance the prepared bar integrity and enhance desired user sensory profiles. Components of this type include fatty acids; salts of fatty acids; polyalkylene glycols and derivatives; starches and dextrins, maltodextrin and other carbohydrates; inorganic particulate materials for example talc, kaolin, bentonite clay, aluminosilicate clays or other clays; carbonate or sulphate salts; glycerol esters or ethylene glycol esters; sugars and crystalline polyols; other waxes and fatty alcohols.

Other additives which may be included in the personal care bar include fragrances or perfumes; germicides; antimicrobial agents; antioxidants; cationic polymers; and sequestering agents for example sodium ethylenediaminetetraacetate (EDTA) and trisodium ethylenediamine disuccinate (EDDS). The personal care bar may include ingredients used to enhance the bar appearance for example pigments, colorants and dyes; opacifiers and pearlizers for example titanium dioxide, zinc stearate or magnesium stearate. The personal care bar may include emollients for example benzoate esters or additional mild surfactants. Surfactants may be selected from anionic, cationic or amphoteric surfactants and include for example, betaines, taurates, alkyl ether carboxylates, acyl glutamates, acyl sarcosinates, alkyl sulfates and alkyl ether sulfates. The personal care bar may also include additional water.

Preferably in the method involves mixing the synthetic-detergent containing component, the soap component and optional further ingredients at a temperature of less than 80° C., preferably less than 60° C., more preferably less than 50° C.

The method of the second aspect suitably comprises processing the mixed ingredients to form a bar. This may be carried out by any suitable means, for example pressing. Other such means will be known to the person skilled in the art.

As mentioned above the present invention finds particular utility when an ethylene vinyl acetate copolymer synthetic wax is used in step (b).

According to a third aspect of the present invention there is provided a composition comprising an isethionate surfactant and an ethylene vinyl acetate co-polymer.

The composition of the third aspect is suitable to be used as a synthetic-detergent containing component of a personal cleansing bar. It may be provided in any suitable form. Preferably it is provided in the form of chips.

Other preferred features of the component of the third aspect are as defined in relation to the first aspect.

Preferably the component of the third aspect comprises at least 20 wt % isethionate surfactant, preferably at least 30 wt %, more preferably at least 40 wt %, for example at least 50 wt %. It may comprise up to 95 wt % isethionate surfactant, preferably up to 90 wt %, more preferably up to 85 wt %, for example up to 75 wt %.

Preferably the component obtained of the third aspect comprises at least 0.5 wt % of an ethylene vinyl acetate co-polymer, preferably at least 0.75 wt %, more preferably at least 1 wt %. It may comprise up to 10 wt % of an ethylene vinyl acetate co-polymer, preferably up to 7.5 wt %, more preferably up to 5 wt %.

Preferably the component of the third aspect comprises at least 5 wt % fatty acids, preferably at least 10 wt %, more preferably at least 15 wt %. Suitably it comprises up to 60 wt % fatty acids, preferably up to 50 wt %, more preferably up to 40 wt %.

Preferably the component obtained of the third aspect comprises less than 40 wt % isethionate salts, preferably less than 30 wt %, more preferably less than 20 wt % and most preferably less than 15 wt % for example less than 10 wt %.

According to a fourth aspect of the present invention there is provided a personal cleansing bar comprising:

(i) an isethionate surfactant;

(ii) an ethylene vinyl acetate co-polymer; and (iii) a soap component.

Preferred features of the fourth aspect are as defined in relation to the first, second and third aspects.

The personal cleansing bar of the present invention offers significant advantages over those of the prior art. Although it may contain a significant amount of the soap component it does not suffer from the grittiness observed with cleansing bars prepared by methods of the prior art. The personal cleansing bar of the present invention thus suitably has an improved texture and a non-gritty feel. In addition the cleansing bar has been found to have a neutral colour and odour, to be mild to the skin and to provide a good lather.

Although the invention finds particular utility in the manufacture of personal cleansing bars comprising both a synthetic-detergent containing component and a soap component it may also be used to provide a soap free cleansing bar.

According to a fifth aspect of the present invention there is provided a method of producing a soap free personal cleansing bar, the method comprising forming the synthetic detergent containing component obtained in the first aspect into a bar.

According to a sixth aspect of the present invention there is provided a soap free personal cleansing bar comprising an isethionate surfactant and an ethylene vinyl acetate co-polymer.

Preferred features of the fifth and sixth aspects are as defined in relation to the first, second, third and fourth aspects. The preferred amounts of the soap free cleansing bar are as defined in relation to the component of the third aspect.

By soap free we mean that the cleansing bar preferably contains less than 5 wt % of a soap component as defined herein, preferably less than 3 wt %, more preferably less than 1 wt %, preferably less than 0.1 wt % and most preferably less than 0.01 wt %.

The invention will now further described with reference to the following non-limiting examples:

Example 1A

Composition A was prepared as follows: 51.6 Kg of sodium isethionate, 54.5 Kg of coconut fatty acids and 3.0 Kg of lauric acid were esterified at 240° C. using 0.1 Kg of zinc oxide catalyst and with removal of water to give a mixture comprising approximately 81% sodium cocoyl isethionate (SCI) and approximately 10% unreacted fatty acid. In a separate vessel, 22.9 Kg of stearic acid, 3.8 Kg of Sensymer™ E and 0.2 Kg titanium dioxide were mixed at 120° C. This mixture was added to the hot SCI mixture and mixed for 15 minutes at 225° C. The final mixture was then cooled to approximately 210° before pouring onto a stainless steel flaking sheet to harden and then flaked.

Sensymer™ E is an ethylene vinyl acetate copolymer available from Innospec and having approximately 12% vinyl acetate content, a viscosity at 140° C. of 400 mPaS and a drop melting point of 99° C.

Example 1B

Comparative

Composition B was prepared as follows: 51.6 Kg of sodium isethionate, 54.5 Kg of coconut fatty acids and 3.0 Kg of lauric acid were esterified at 240° C. using 0.1 Kg of zinc oxide catalyst and with removal of water to give a mixture comprising approximately 81% sodium cocoyl isethionate (SCI) and approximately 10% unreacted fatty acid. In a separate vessel, 22.9 Kg of stearic acid (vegetable based), 1.8 Kg of PEG-400 and 2.0 KG PEG-600 and 0.2 Kg titanium dioxide were mixed at 120° C. This mixture was added to the hot SCI mixture and mixed for 15 minutes at 225° C. The final mixture was then cooled to approximately 210° C. before pouring onto a stainless steel flaking sheet to harden and then flaked.

Example 1C

Composition C was prepared as follows: 51.6 Kg of sodium isethionate, 54.5 Kg of coconut fatty acids and 3.0 Kg of lauric acid were esterified at 240° C. using 0.1 Kg of zinc oxide catalyst and with removal of water to give a mixture comprising approximately 81% sodium cocoyl isethionate (SCI) and approximately 10% unreacted fatty acid. In a separate vessel, 22.9 Kg of stearic acid (Tallow based), 3.8 Kg of Sensymer™ E and 0.2 Kg titanium dioxide were mixed at 120° C. This mixture was added to the hot SCI mixture and mixed for 15 minutes at 225° C. The final mixture was then cooled to approximately 210° C. before pouring onto a stainless steel flaking sheet to harden and then flaked.

Example 1D

Composition D was prepared as follows: 51.6 Kg of sodium isethionate, 54.5 Kg of coconut fatty acids and 3.0 Kg of lauric acid were esterified at 240° C. using 0.1 Kg of zinc oxide catalyst and with removal of water to give a mixture comprising approximately 81% sodium cocoyl isethionate (SCI) and approximately 10% unreacted fatty acid. In a separate vessel, 25.8 Kg of stearic acid were melted at 120° C. and added to the hot SCI mixture and mixed for 15 minutes at 225° C. The final mixture was then cooled to approximately 210° before pouring onto a stainless steel flaking sheet to harden and then flaked.

Examples 1E to 1I

Compositions E-G were prepared using a method analogous to that described in Example 1A. Each composition included the following base ingredients but included a different wax as detailed below:

| | |
|---|---|
| Sodium Isethionate | 379.4 g |
| Coconut fatty acid | 400.6 g |
| Lauric acid | 21.7 g |
| Zinc oxide | 0.8 g |
| Triple press stearic acid | 168.4 g |
| Titanium dioxide | 1.3 g |
| Waxes (natural) | 27.8 g |

The waxes used were:

E—Synthetic polyethylene wax having a drop melting point of 104° C.;

F—Beeswax—a natural mixture of fatty acids, and fatty esters including hydroxy esters;

G—Ross wax—a mineral oil wax, predominantly hydrocarbon having a melting point around 70° C. and available from Frank B.Ross Co;

H—Ceresin wax—a mineral wax available from Akrochem Corporation;

I—Castorwax MP-80—a high melting point wax derived from hydrogenated castor oil and available from HallStar Co.

TABLE 1

| Example No | Composition | Wax Component used | Colour | Odour |
|---|---|---|---|---|
| 1A | A | Sensymer E | Good | Good |
| 1B | B | Mixture of PEG 400 and PEG 600 | Poor | Poor |
| 1C | C | Sensymer E | Good | Good |
| 1D | D | None | Good | Good |
| 1E | E | Synthetic polyethylene wax having a drop melting point of 104° C. | Good | Good |
| 1F | F | Beeswax (1) | Dark | Bad |
| 1G | G | Ross wax 160 (2) | Dark | Bad |
| 1H | H | Cerasin wax (3) | Dark | Bad |
| 1I | I | Castorwax MP-80 (4) | Dark | Bad |

Example 2

Compositions A to D of example 1 were used to prepare soap bars having the ingredients listed in table 2. All ingredients are given as percentages by weight.

TABLE 2

| Ingredient: | Example 2A | 2B | 2C | 2D | 2E | 2F | 2G | 2H | 2I |
|---|---|---|---|---|---|---|---|---|---|
| A | | 78.4 | 80 | 75 | | | | 16.5 | |
| B | 80 | | | | | | | | 75 |
| C | | | | | 75 | 75 | | | |
| D | | | | | | | 16 | | |
| Soap, 80:20 palm:coconut | 13 | 12.7 | 13 | 18 | 18 | | 74 | 81.96 | 18 |
| Soap, 85:15 tallowate:cocoate | | | | | | 18 | | | |
| Stearic Acid 1890 | 5 | 4.9 | 5 | 5 | 5 | 5 | 10 | 1.1 | 5 |
| Mirataine BET C-30 (CAPB) | 1 | 1 | 1 | 1 | 1 | 1 | | 0.22 | 1 |
| Hostapon SI (Sodium Isethionate) | 1 | 1 | 1 | 1 | 1 | 1 | | 0.22 | 1 |
| water | | 2 | | | | | | | |
| fragrance | | | | | | | | | |
| | 100 | 100 | 100 | 100 | 100 | 100 | 100 | 100 | 100 |

Mirataine BET C-30 is an approx 30% aqueous solution of Cocamidopropyl betaine available from Rhodia Novecare.
Hostapon SI approx 57% is an aqueous solution of Sodium Isethionate available from Clariant
Stearic Acid 1890 is mixture of fatty acids comprising 90% stearic acid.

Each of the soap bars 2A to 2H were assessed for bar feel, odour, foam, hardness and mush using the procedures outlined below.

The results are shown in table 3:

TABLE 3

| Example | Bar feel | Odour | Foam | Hardness | Mush |
|---|---|---|---|---|---|
| 2A | smooth | poor | 73 | 32 | |
| 2B | smooth | good | 163 | 25 | |
| 2C | smooth | good | 90 | 20 | 9.87 |
| 2D | smooth | good | 95 | 19 | 7.58 |
| 2E | smooth | good | | 15 | |
| 2F | smooth | good | 80 | 25 | 14.25 |
| 2G | gritty | good | | | |
| 2H | smooth | good | 30 | 60 | 7.94 |
| 2I | smooth | poor | | 26 | |

Bar hardness was measured using the ASTM Standard Test Method D1321-10. This method measures the extent of penetration of a standard needle into the test material, in this case a bar preparation. The method measures the depth to which a standard needle penetrates the bar surface. A penetrometer is an instrument that measures the depth to which a needle under a given force falls into the material. A standard penetrometer needle was used with a penetration force of 100 g which is the total mass of the needle, plunger and 50 g weight. Bars were equilibrated under controlled conditions of 25° C. and 50% RH. In the method a 50 g weight is placed above the penetrometer needle. The bar is positioned under the needle and the needle is lowered until the tip is touching the bar surface and is then locked into position. The indicator needle on the penetrometer is adjusted to read zero. When the above conditions are set, the needle shaft is then released and held free for 5 seconds. The indicator shaft is then depressed until it is stopped by the needle shaft. The penetration value is read from the indicator scale. Measurements were made on four points on a given bar surface and the results averaged to give the final penetration value in mm. A higher value indicates a softer material.

Bar mush was measured as follows: a pre-weighed bar sample is immersed in 250 mL of water maintained at 25° C. for 4 hours. After this time, the bar is removed from the water and the mush, or soft hydrated layer, is scraped from the bar with a plastic spatula. The scraped bar is dried for 24 hours at room temperature and then weighed. The mush percentage is calculated as the weight change of the bar divided by the initial bar weight multiplied by 100.

The foam volume was measured as follows: bars were pre-treated by washing with gloved hands in running tap water for 1 minute by twisting the bars between the hands about 20 times. The bar is held under running tap water and removed. The bar is rotated 15 times between the gloved hands and then placed to the side. The lather is generated in the next two steps. In step 1 the tips of the fingers of one hand are rubbed on the palm of the other 10 times. Then in step 2, one hand is used to grip the other to squeeze the foam off of the hand and into a 250-mL beaker. For smaller foal volumes use a 150-mL beaker. Repeat step 2 five times with each hand. Hold the bar again under running tap water, remove and repeat the whole procedure of lather generation twice more, combining all the lather in the beaker. Stir the collected foam gently to release large pockets of air. Record the foam volume in milliliters.

The invention claimed is:

1. A method of preparing a component of a personal care bar, the method comprising:

(a) providing a composition comprising an isethionate surfactant at a temperature of at least 120° C.;

(b) combining the composition comprising the isethionate surfactant with a synthetic wax and optional further components at a temperature of at least 120° C.; and (c) cooling the mixture obtained in step (b);

wherein the synthetic wax is an ethylene vinyl acetate copolymer.

2. A method of preparing a personal care bar, the method comprising preparing a component of a personal care bar according to claim 1 and combining the component with a soap component and optional further ingredients.

3. A method of preparing a personal care bar, the method comprising:

(a) providing a composition comprising an isethionate surfactant at a temperature of at least 120° C.;

(b) combining the composition comprising the isethionate surfactant with a synthetic wax and optional further components at a temperature of at least 120° C.; and (c) cooling the mixture obtained in step (b) forming into chips; and (d) combining the chips obtained in step (c) with chips of a soap component and optional further ingredients;

wherein the synthetic wax is an ethylene vinyl acetate copolymer.

4. A personal cleansing bar comprising:

(i) an isethionate surfactant;

(ii) an ethylene vinyl acetate co-polymer; and (iii) a soap component, wherein the isethionate surfactant comprises at least 30 wt % based on the total amount of the isethionate surfactant and the ethylene vinyl acetate co-polymer.

5. A personal cleansing bar according to claim 4 which further comprises one or more components selected from: fatty acids; salts of fatty acids; polyalkylene glycols and derivatives; starches and dextrins, maltodextrin and other carbohydrates; inorganic particulate materials for example talc, kaolin, bentonite clay, aluminosilicate clays or other clays; carbonate or sulphate salts; glycerol esters or ethylene glycol esters; sugars and crystalline polyols; other waxes and fatty alcohols; fragrances or perfumes; germicides; antimicrobial agents; antioxidants; cationic polymers; sequestering agents for example sodium ethylenediaminetetraacetate (EDTA) and trisodium ethylenediamine disuccinate (EDDS); pigments, colorants and dyes; opacifiers and pearlizers for example titanium dioxide, zinc stearate or magnesium stearate; emollients for example benzoate esters; additional anionic, cationic or amphoteric surfactants for example, betaines, taurates, alkyl ether carboxylates, acyl glutamates, acyl sarcosinates, alkyl sulfates and alkyl ether sulfates; and additional water.

6. A personal cleansing bar according to claim 4 having a non-gritty feel.

7. A method of producing a soap free personal cleansing bar, the method comprising forming the synthetic detergent containing component obtained by the method of claim 1 into a bar.

8. A soap free personal cleansing bar comprising an isethionate surfactant and an ethylene vinyl acetate co-polymer, wherein the isethionate surfactant comprises at least 30 wt %.

9. A method of preparing a component of a personal care bar according to claim 1, wherein the ethylene vinyl acetate copolymer comprises 2 to 30% vinyl acetate.

10. A method of preparing a component of a personal care bar according to claim 3, wherein the ethylene vinyl acetate copolymer comprises 2 to 30% vinyl acetate.

11. A personal cleansing bar according to claim 4, wherein the ethylene vinyl acetate copolymer comprises 2 to 30% vinyl acetate.

12. A soap free personal cleansing bar according to claim 8, wherein the ethylene vinyl acetate copolymer comprises 2 to 30% vinyl acetate.

13. A method of preparing a component of a personal care bar according to claim 1, wherein the ethylene vinyl acetate copolymer has a drop melting point of greater than 70° C.

14. A method of preparing a component of a personal care bar according to claim 3, wherein the ethylene vinyl acetate copolymer has a drop melting point of greater than 70° C.

15. A personal cleansing bar according to claim 4, wherein the ethylene vinyl acetate copolymer has a drop melting point of greater than 70° C.

16. A soap free personal cleansing bar according to claim 8, wherein the ethylene vinyl acetate copolymer has a drop melting point of greater than 70° C.

17. A method of preparing a component of a personal care bar according to claim 1, wherein the ethylene vinyl acetate copolymer has a viscosity at 140° C. of from 250 to 750 $mm^2s^{-1}$.

18. A method of preparing a component of a personal care bar according to claim 3, wherein the ethylene vinyl acetate copolymer has a viscosity at 140° C. of from 250 to 750 $mm^2s^{-1}$.

19. A personal cleansing bar according to claim 4, wherein the ethylene vinyl acetate copolymer has a viscosity at 140° C. of from 250 to 750 $mm^2s^{-1}$.

20. A soap free personal cleansing bar according to claim 8, wherein the ethylene vinyl acetate copolymer has a viscosity at 140° C. of from 250 to 750 $mm^2s^{-1}$.

21. The personal cleansing bar according to claim 4, wherein the soap component comprises 5 to 90 wt %.

22. The personal cleansing bar according to claim 21, which further comprises one or more components selected from: fatty acids; salts of fatty acids; polyalkylene glycols and derivatives; starches and dextrins, maltodextrin and other carbohydrates; inorganic particulate materials for example talc, kaolin, bentonite clay, aluminosilicate clays or other clays; carbonate or sulphate salts; glycerol esters or ethylene glycol esters; sugars and crystalline polyols; other waxes and fatty alcohols; fragrances or perfumes; germicides; antimicrobial agents; antioxidants; cationic polymers; sequestering agents for example sodium ethylenediaminetetraacetate (EDTA) and trisodium ethylenediamine disuccinate (EDDS); pigments, colorants and dyes; opacifiers and pearlizers for example titanium dioxide, zinc stearate or magnesium stearate; emollients for example benzoate esters; additional anionic, cationic or amphoteric surfactants for example, betaines, taurates, alkyl ether carboxylates, acyl glutamates, acyl sarcosinates, alkyl sulfates and alkyl ether sulfates; and additional water.

23. The personal cleansing bar according to claim 21, having a non-gritty feel.

24. A personal cleansing bar comprising:

(i) an isethionate surfactant;

(ii) an ethylene vinyl acetate co-polymer; and (iii) a soap component, wherein the soap component comprises 5 to 90 wt %.

25. A personal cleansing bar according to claim 24, which further comprises one or more components selected from: fatty acids; salts of fatty acids; polyalkylene glycols and derivatives; starches and dextrins, maltodextrin and other carbohydrates; inorganic particulate materials for example talc, kaolin, bentonite clay, aluminosilicate clays or other clays; carbonate or sulphate salts; glycerol esters or ethylene glycol esters; sugars and crystalline polyols; other waxes and fatty alcohols; fragrances or perfumes; germicides; antimicrobial agents; antioxidants; cationic polymers; sequestering agents for example sodium ethylenediaminetetraacetate (EDTA) and trisodium ethylenediamine disuccinate (EDDS); pigments, colorants and dyes; opacifiers and pearlizers for example titanium dioxide, zinc stearate or magnesium stearate; emollients for example benzoate esters; additional anionic, cationic or amphoteric surfactants for example, betaines, taurates, alkyl ether carboxylates, acyl glutamates, acyl sarcosinates, alkyl sulfates and alkyl ether sulfates; and additional water.

26. A personal cleansing bar according to claim 24, having a non-gritty feel.

* * * * *